United States Patent [19]

Weissman

[11] Patent Number: 4,909,395

[45] Date of Patent: Mar. 20, 1990

[54] DISPENSING CARTON

[75] Inventor: Neal Weissman, New York, N.Y.

[73] Assignee: Colgate-Palmolive Company, Piscataway, N.J.

[21] Appl. No.: 322,372

[22] Filed: Mar. 13, 1989

[51] Int. Cl.[4] ..... B65D 5/70

[52] U.S. Cl. ..... 206/621.6; 206/611; 206/621.3; 206/626

[58] Field of Search ..... 206/611, 626, 628, 621.6, 206/621.3, 631.2

[56] References Cited

U.S. PATENT DOCUMENTS

| | | | |
|---|---|---|---|
| Re. 25,449 | 4/1961 | Gill . | |
| 939,825 | 11/1909 | Frank . | |
| 1,303,138 | 5/1919 | Woolwine . | |
| 1,437,511 | 12/1922 | Gereke . | |
| 1,739,529 | 12/1929 | Skinner . | |
| 1,953,385 | 4/1943 | Auch . | |
| 2,010,972 | 8/1935 | Weiss | 206/626 |
| 2,128,893 | 9/1938 | Bergstein . | |
| 2,166,222 | 7/1939 | Ranko . | |
| 2,360,415 | 10/1944 | Gilbert . | |
| 2,470,388 | 5/1949 | Ball | 206/611 |
| 2,766,922 | 10/1956 | Moore . | |
| 2,925,948 | 2/1960 | Alden . | |
| 2,983,422 | 5/1961 | Miller . | |
| 3,015,432 | 1/1962 | Tyrseck . | |
| 3,096,921 | 7/1963 | Graybill . | |
| 3,147,905 | 9/1964 | Gill . | |
| 3,155,306 | 11/1964 | Moore . | |
| 3,185,374 | 5/1965 | Feeney . | |
| 3,203,616 | 8/1965 | Bolton . | |
| 3,262,630 | 7/1966 | Koolnis . | |
| 3,270,942 | 9/1966 | Cope . | |
| 3,346,166 | 10/1967 | Koolnis . | |
| 3,361,332 | 1/1968 | Mason . | |
| 3,395,848 | 8/1968 | Johnson . | |
| 3,438,565 | 4/1969 | Lugt . | |
| 3,648,921 | 3/1972 | Lock | 206/604 |
| 3,770,185 | 11/1973 | Reeves | 206/621 |
| 3,971,506 | 7/1976 | Roenna | 206/621.3 |
| 4,015,768 | 4/1977 | McLennan | 206/621.3 |
| 4,019,673 | 4/1977 | Salomons | 206/621.3 |
| 4,142,635 | 3/1979 | Capo | 206/625 |
| 4,168,003 | 9/1979 | Wysocki | 206/611 |
| 4,258,876 | 3/1981 | Ljungcrantz | 206/626 |
| 4,308,956 | 1/1982 | Steinke | 206/611 |
| 4,473,168 | 9/1984 | Cox | 220/258 |
| 4,482,056 | 11/1984 | Dutcher | 206/611 |
| 4,498,589 | 2/1985 | Scott | 206/526 |
| 4,516,689 | 5/1985 | Barker | 220/335 |
| 4,609,142 | 9/1986 | Adamek | 206/620 |
| 4,706,875 | 11/1987 | Blackman | 206/626 |
| 4,718,557 | 1/1988 | Friedman | 206/621.3 |
| 4,732,315 | 3/1988 | Gunn | 229/125.09 |
| 4,782,996 | 11/1988 | Spahni, Jr. | 229/125.09 |
| 4,799,594 | 1/1989 | Blackman | 206/626 |
| 4,809,853 | 3/1989 | Weber | 206/621.4 |

FOREIGN PATENT DOCUMENTS

| | | | |
|---|---|---|---|
| 615973 | 3/1961 | Canada . | |
| 8001370 | 10/1981 | Netherlands | 206/621.3 |
| 1353079 | 5/1974 | United Kingdom . | |

*Primary Examiner*—Gary Elkins

*Attorney, Agent, or Firm*—Richard J. Ancel; Robert C. Sullivan; Murray M. Grill

[57] ABSTRACT

A paperboard carton for dispensing powders or other dry particulate material is formed from a single blank of paperboard or other stiff, resilient and foldably sheet material. The carton includes an opening flap having a projecting end for easy grasping by the user, and which operates by a toggle action, to remain in its open position. The paperboard at the adhesive area of the opening flap is partially precut to control the extent of paperboard ripping upon initial carton opening. An area around the forward portion of the dispensing aperture is precut to permit a forward part of the opening flap to be pushed down for releasably locking reclosure.

11 Claims, 4 Drawing Sheets

DISPENSING CARTON

BACKGROUND OF THE INVENTION

This invention relates to a dispensing carton and blank for making it, and more particularly to a carton formed from a unitary blank of paperboard, the blank provided with fold lines to define generally rectangular side, end, top closure and bottom closure panels.

The dispensing carton art is aware of a variety of such constructions, in general, but none exhibits the particular combination of features of the present invention, such as ease of opening for partial dispensing of the carton contents (typically dry particulate matter) and ease of reclosing.

SUMMARY OF THE INVENTION

According to the practice of this invention, a paperboard dispensing carton is provided with an inner and an outer top closure panel. The inner panel has a precut dispensing aperture whose forward sides are partially weakened by cutting and scoring. The outer top closure panel carries a hingable opening flap, the latter being wider than the dispensing opening. After initial opening, the opening flap is reclosable by pushing it down, its forward end distorting and bending the weakened sides of the dispensing aperture and a locking tab on the opening flap lodging beneath the forward end of the dispensing aperture. From this latched position, the opening flap can be reopened for a second dispensing operation.

The portion of the inner top closure panel between its forward edge and the dispensing aperture defines a bridge, the upper surface of the bridge being partially precut. The forwardmost section of the opening flap is foldably connected to the flap's rearwardmost portion, the forwardmost portion being initially sealed as by an adhesive to the bridge. This arrangement permits the tearing of the paperboard to be localized and thus limited to the bridge.

The rearwardmost end of the opening flap carries a tongue engageable with a roughened portion of the inner top closure flap, the arrangement being such that a toggle action maintains the opening flap in its open position upon dispensing.

The opening flap is provided with a convex free end, cooperating with a concave free edge of the bridge and with a concave fold line portion at the top of an end panel, to provide easy access to the opening flap free end for grasping to open.

DETAILED DESCRIPTION OF THE INVENTION

Figure 1:
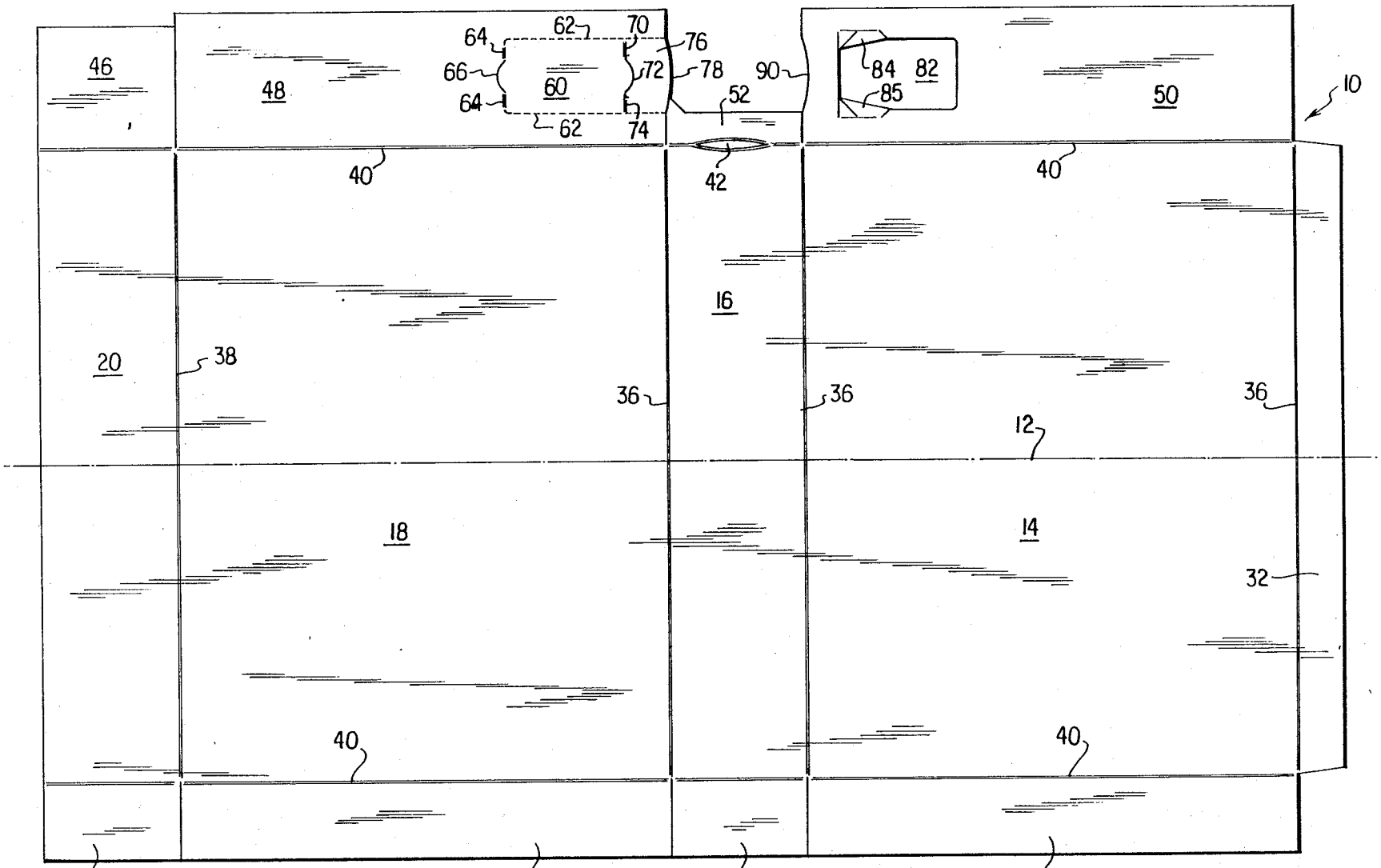
FIG. 1 is a plan view of a blank from which the carton of this invention is formed, that surface which is to be the carton interior facing the reader.
Figure 2:
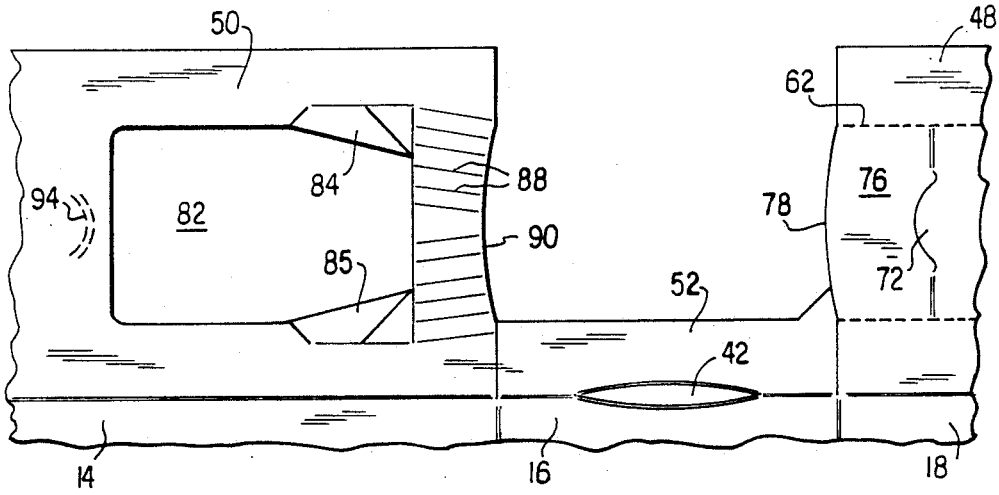
FIG. 2 is a partial view of the blank of FIG. 1, taken from that side of the blank which will form the carton exterior.

Referring now to FIGS. 1 and 2 of the drawings, the numeral 10 denotes generally a unitary paperboard blank from which the carton of this invention is fashioned. The numeral 12 denotes a central, longitudinal axis of the blank running horizontally. In this connection, the terms horizontal, vertical, rearward, forward, and other geometrical terms of orientation are employed in the description to facilitate an understanding of the invention and are not used as terms of limitation in the claims. The numeral 14 denotes a first side panel foldably connected to a first end panel, the latter foldably connected to a second side panel 18, the latter foldably connected to a second end panel 20. The lowermost portion of panel 20 is foldably connected to a bottom end closure forming flap 24, with similar bottom closure flaps 26, 28 and 30 being foldably secured to, respectively, panels 18, 16 and 14. The numeral 32 denotes a conventional manufacturer's flap. These panels, together with others soon to be described, are defined by vertically extending score lines 36 and horizontally extending score lines 40 which define fold lines. The numeral 42 denotes a generally elliptical portion of the blank, at the top of panel 16, defined by the indicated two arcuate portions or splits of upper fold line 40 which diverge and then converge together. The purpose of these curved portions will later be described.

The numerals 46 and 52 denote dust flaps foldably secured, respectively, to panels 20 and 16. The numerals 48 and 50 denote, respectively, outer and inner top closure panels.

Referring now to outer top panel 48, the numeral 60 denotes an opening flap defined by perforated and horizontally extending lines 62, with the left end of flap 60 including hinge portions 64 and a precut curved line defining a tongue 66. The numerals 70 and 74 denote scored, hinge defining lines, similar to lines 64, and a reconnected by a precut curved line which defines a locking tab 72. The numeral 76 denotes the forwardmost portion or segment flap 60, with the term forwardmost in FIG. 1 referring to the right hand portion of flap 60, and with that portion of flap 60 between cuts 66 and 72 being a rearwardmost portion of the opening flap 60. The numeral 78 denotes a convex portion at the free end of opening flap 60.

The numeral 82 denotes a precut dispensing opening having a right hand or rearwardmost portion and a left hand or forwardmost portion, the latter bordered by side flexing elements 84 and 85, the latter defined by the indicated cut and score lines. The numeral 90 denotes a concave portion of the free or left hand end of inner top closure panel 50.

That surface of the blank 10 which faces the reader is to be the inside surface of the container formed from the blank.

Referring now to FIG. 2 of the drawings, a portion of the blank 10 as illustrated, this portion being the external or outside portion of the blank. The reader will observe that that portion of the free end of inner top closure panel 50 which is between concave portion 90 and dispensing opening 82, termed a bridge, is provided with a plurality of cuts 88 extending partially through the paperboard. The function of these cuts will presently be described. The numeral 94 in FIG. 2 denotes a roughened area on the outer or external surface of panel 50, with 94 being defined by partial cuts through the paperboard for the purpose of defining a roughened area.

Figure 3:
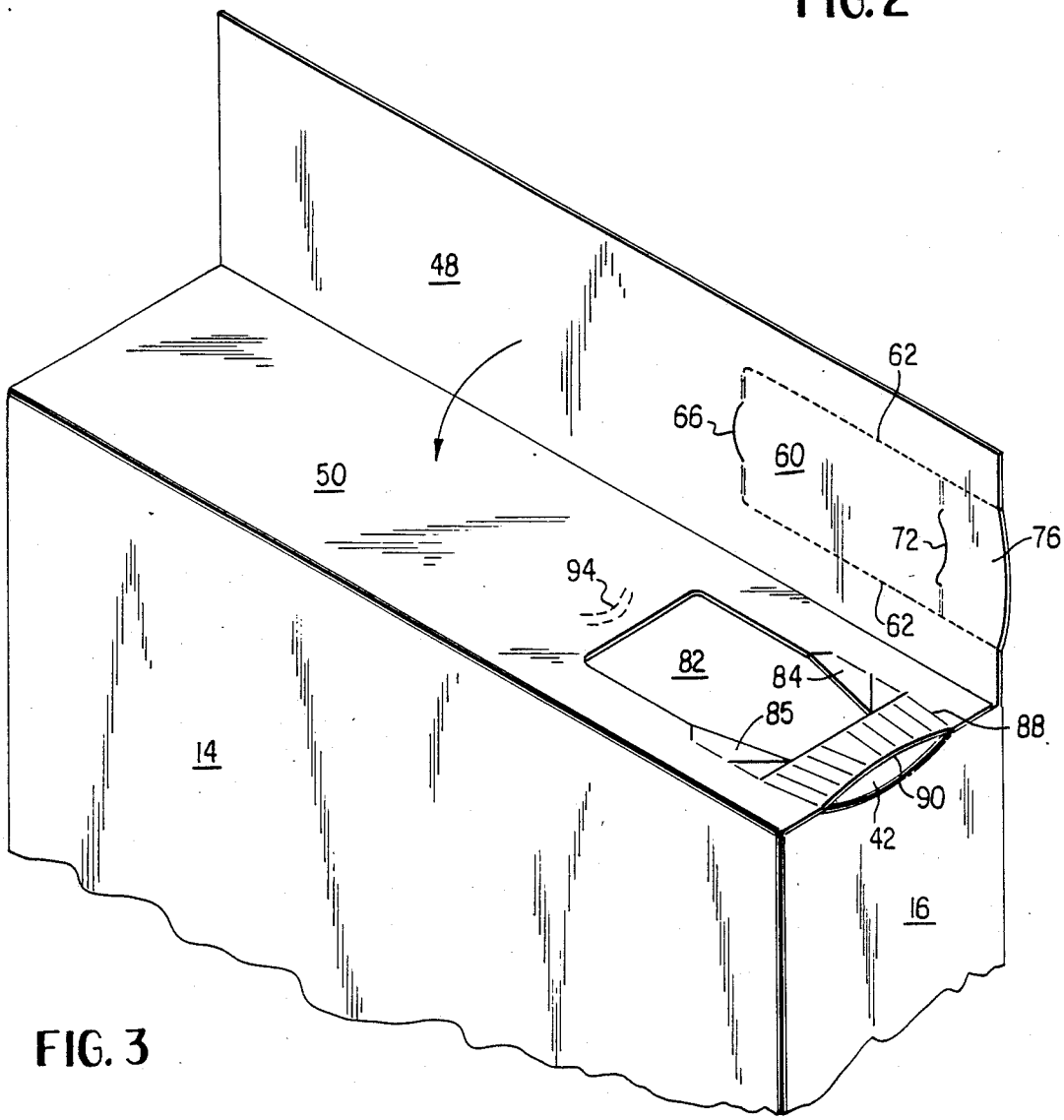
FIG. 3 is a perspective view of the upper portion of a carton formed from the blank of FIG. 1 prior to closing its outermost top closure flap.

Referring now to FIG. 3, the blank has been folded to assume a generally tubular and rectangular portion, with the upper portion only being illustrated. Dust flap 52 has been folded at right angles to panel 16 and is adhered to, as by an adhesive, the bottom of the bridge portion containing partial cuts 88. From the position illustrated at FIG. 3, top closure panel 48 is folded in the direction of the curved arrow, and is secured as by an adhesive to panel 50. It will here be observed that the width of opening flap 60 is greater than the width of dispensing aperture 82, so that perforated lines 62 extend laterally beyond the parallel, longitudinal edges of dispensing aperture 82.

Figure 4:
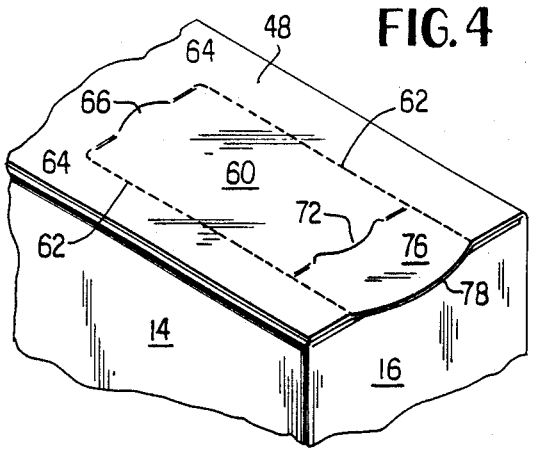
FIG. 4 is a perspective view of the upper, dispensing corner of a closed carton formed from the blank of FIG. 1.

FIG. 4 shows the completed configuration of the dispensing portion of the container after closing, this being the configuration of the container when purchased by a user. As will shortly become evident, portion 42, at the juncture of dust flap 52 and end panel 16, together with concave edge portion 90 and convex edge portion 78, provide an easy access for the user to place the end of a finger underneath portion 76 of opening flap 60 and thus initial opening by grasping.

Figure 5:
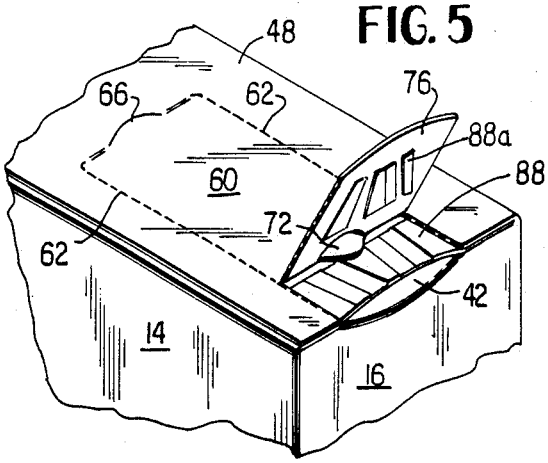
FIG. 5 is a view, similar to FIG. 4, showing the first step in opening the carton.

FIG. 5 illustrates the first step in opening the container. As above noted, the user grasps the convex end 78 of segment 76 and pulls upwardly. This causes a portion of the paperboard between lines 88 on the bridge to be pulled up with segment 76 of flap 60, the tearing or ripping action of the paperboard thus being controlled so as to insure that paperboard tearing or ripping does not extend beyond the portion of the bridge provided with precut lines 88. The numeral **88*a* denotes those portions of the bridge which are ripped up upon pivoting of portion 76. Again referring to FIG. 5, the reader will observe that locking tab 72 is positioned on top of the bridge, and extends slightly beyond the forwardmost end of dispensing aperture 82. It will here again be observed that the term forwardmost refer to the right hand portion of FIGS. 4 through 8**, while the term rearwardmost refers to the left hand portion of this aperture and other elements associated with it.

Figure 6:
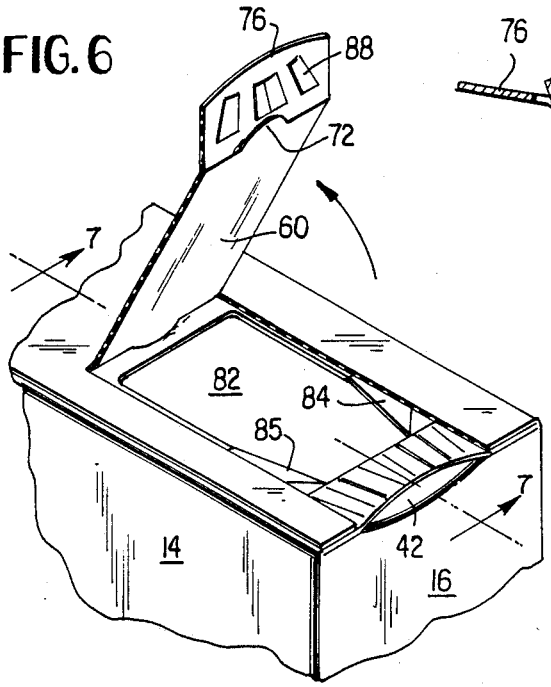
FIG. 6 is a view, similar to FIG. 5, showing a later stage in opening the carton.
Figure 7:
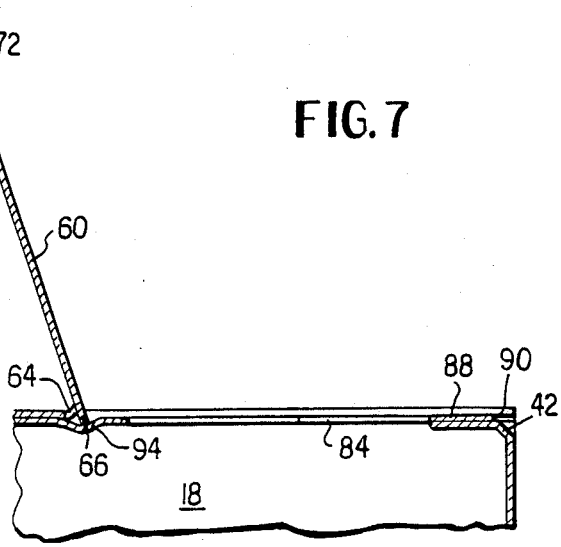
FIG. 7 is a cross sectional view, taken along 7—7 of FIG. 6, showing the carton fully open and ready for dispensing a portion of its contents.

Referring now to FIG. 6 of the drawings, the user has now pulled portion 76 of opening flap 60 further upward and this swinging motion of the flap, taking place about hinged portions 64, continues until the configuration of FIG. 7 is reached. At this point, tongue 62 has resiliently borne against the paperboard, at roughened region 94, and has reached an overcenter or toggle position whereby the opening flap 60 is maintained as indicated at FIG. 7, so as not to interfere with dispensing of the contents of the container.

Figure 8:
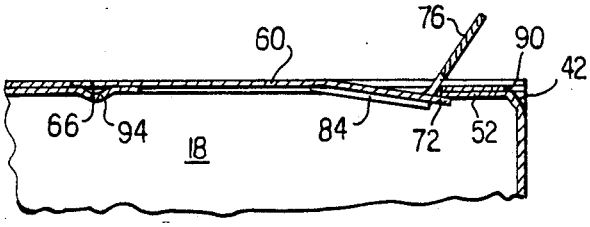
FIG. 8 is a cross sectional view, similar to FIG. 7, showing the carton reclosed and ready for another partial dispensing of its contents.

Referring now to FIG. 8 of the drawings, at the conclusion of a partial dispensing operation of the container contents, flap 60 is reclosed and pushed back to its initial position, with forwardmost or righthand portion of flap 60, to the left of tab 72, having been pushed against and deforming and bending downward flexing portions 84 and 85 which are located at the forwardmost sides of opening 82. In this configuration, tab 72 is now lodged beneath the free edge or ledge of dust flap 52, with the resiliency of the paperboard holding flap 60 in the position indicated at FIG. 8 until it is desired to commence a second partial dispensing of the carton contents. The reader will observe that roughened portion 94 has been shown as deformed at FIGS. 7 and 8, and it will be understood that this is for purpose of illustration and clarity of understanding of the overcenter or toggle locking action of flap 60.

Figure 9:
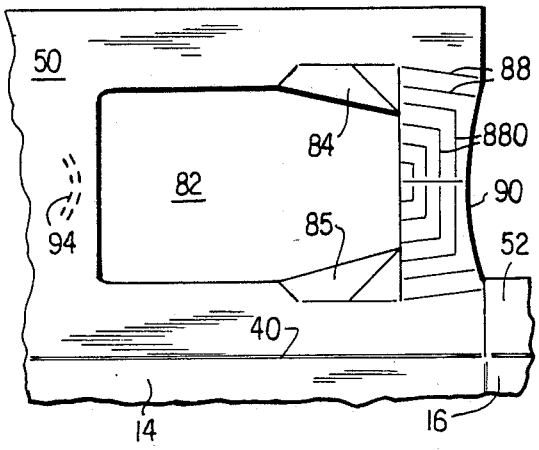
FIG. 9 is a partial plan view of a blank, similar to FIG. 2, showing the outside surface of a modification of the blank.

Referring now to FIG. 9 of the drawings, a modification is illustrated wherein the bridge between the dispensing aperture 82 and concave portion 90 is provided both with straight precut lines 88 and generally U-shaped precut lines 880, all of which extend partially through the paperboard. FIG. 9 is a view of the outside surface of a blank having this modification. The operation above described is the same as for the embodiment shown at FIG. 9.

Figure 10:
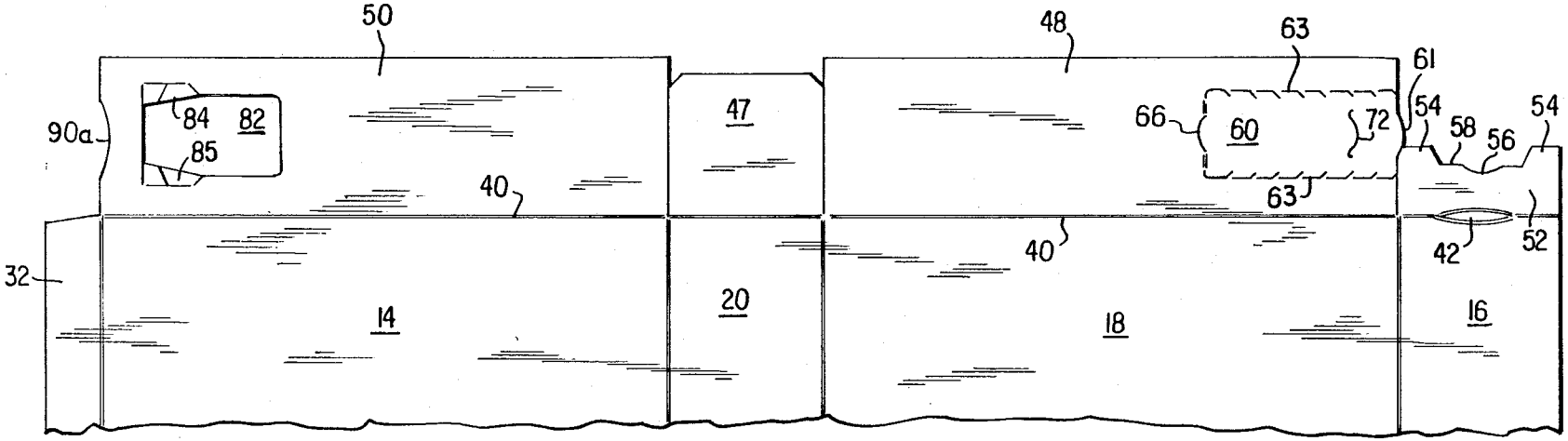
FIG. 10 is a partial plan view, similar to that of FIG. 1, showing the inside surface of a further modification of the blank.

Referring now to FIG. 10 of the drawings, another modification is illustrated wherein the relative positions of panels 14 and 18 are interchanged, the main purpose being to facilitate operating on the folded blanks to meet the requirements of certain production machines, the latter forming no part of this invention. FIG. 10 also represents another modification, here one wherein convex free end 78 of opening flap 60 is replaced by a convex portion 61 of lesser vertical extent. Similarly, concave portion 90 is replaced by convex portion **90*a* which is also of lesser vertical extent. Further, dust flap 52 is modified so as to include upstanding portions 54, separate by portions 58 and a central concave portion 56 in its free edge. It will be noted that FIG. 10 illustrates the inside surface of the blank of the indicated modification. In this embodiment locking tab 72 lodges beneath the bridge portion, the tab 72 bypassing dust flap 52 by virtue of recess 56. However, recess 56 may be omitted, with the locking action being that shown in FIG. 8**.

Figure 11:
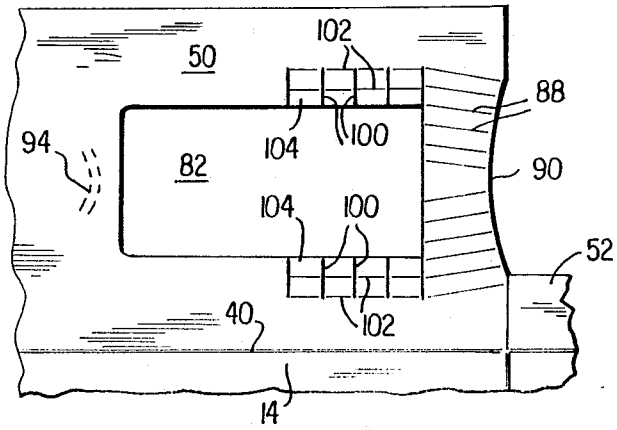
FIG. 11 is a view similar to FIG. 9 showing the outside surface of still another modification of the blank.

Referring now to FIG. 11, still another modification is illustrated wherein inner top closure panel 50 has its dispensing aperture 82 provided, at its forwardmost portion, with a plurality of generally vertically extending cutlines 100 intersected by a plurality of generally horizontally extending perforated or scored lines 102. These intersections define a plurality of small panels 104 which are generally rectangular. The axial extent of panels 104 is less than one-half of the total longitudinal axial extent of dispensing opening 82, as is the case with side portions 84 and 85 of the previously described embodiments. In the operation of the embodiment of FIG. 11, the action is similar to that shown at FIG. 8, wherein the rearward segment of opening flap 60, rearward of tab 72, is pushed downwardly into dispensing opening 82, thereby flexing and bending sections 104 an thus permitting the locking tab 72 to lodge or catch beneath the ledge or free edge of dust flap 52 and one edge of the bridge portion between the forwardmost portion of dispensing opening 82 and concave portion 90 of flap 50.

I claim:

1. A unitary blank of stiff, resilient and foldable sheet material, such as paperboard, the blank having a plurality of horizontal and vertical scores to define generally rectangular, serially arranged panels foldably secured to each other, the panels including a first side panel, a first end panel, a second side panel, a second end panel, bottom closure forming panels foldably secured to at least some of the bottom ends of said side and end panels, an inner top closure panel foldably secured to the top of one side panel, an outer top closure panel foldably secured to the top of the other side panel, said outer top panel having a generally rectangular opening flap at its forward end defined by a pair of spaced apart tear lines, said opening flap including a rear segment foldably connected to said top closure panel and a front segment foldably connected to said rear segment, said rear segment having a precut lined defining a locking tab located at a fold line connecting said segments, said inner top flap having a generally rectangular precut dispensing aperture near but spaced from its forward free end by a bridge panel, the sides of the forward end of the dispensing aperture provided with means to permit the sides of the forward end only of the dispensing aperture to flex downwardly from the plane of said inner top closure panel, the width of said dispensing aperture being less than the width of the rearward segment of said opening flap.

2. The blank of claim 1 wherein said means is defined by a plurality of generally vertically extending precuts which are intersected by a plurality of generally horizontally extending scores.

3. The blank of claim 1 wherein the rearmost end of said rear opening flap segment is provided with a rearwardly projecting tongue, a roughened area on the external surface of said inner top closure flap adjacent the rearward end of said dispensing aperture.

4. The blank of claim 1 wherein the external surface of said bridge panel is provided with a plurality of precuts extending only partially through the bridge.

5. The blank of claim 1 wherein that end panel nearest said opening flap is provided with a top dust flap foldably connected thereto, said foldable connection including a pair of split, generally curved fold lines, the forwardmost, free edge of said opening flap being convex, the forwardmost, free edge of said inner top closure flap being concave.

6. A dispensing carton formed from the blank of claim 1.

7. A reclosable carton formed at a unitary blank of paperboard, the carton being in the form of a rectangular parallel piped having two opposite side panels, two opposite end panels, bottom closure panels, and a top closure including superposed inner and outer top closure panels, said inner panel having a precut, generally rectangular dispensing aperture located near one end of aid top closure (being the forwardmost end thereof), the forwardmost end only of said dispensing aperture provided with means to permit the opposite sides thereof to bend and resiliently flex downwardly towards the carton interior, said outer top closure panel including an opening flap having a free, finger-graspable end contiguous to the forwardmost end of said top closure panel and being foldably connected at its opposite end to said outer top closure panel and defined by parallel, spaced perforated lines in said top closure panel, said opening flap being wider than and overlying said dispensing aperture, said opening flap having a portion bendable toward the carton interior and against said means to thereby bend said sides of said dispensing aperture toward the carton interior, said opening flap carrying a latching tab which is releasably engageable beneath a top closure ledge bordering the forwardmost portion of said dispensing aperture to latch said opening flap closed after its initial opening.

8. The carton of claim 7 wherein said means is defined by a plurality of generally vertically extending precuts which are intersected by a plurality of generally horizontally extending scores.

9. The carton of claim 7 wherein said opening flap includes a rear segment foldably connected to said top closure panel and a front segment foldably connected to said rear segment, the rearmost end of said rear opening flap segment being provided with a rearwardly projecting tongue, the forwardmost end of said rear opening flap segment carrying said latching tab, a roughened area on the external surface of said inner top closure flap contiguous to and engageable by said rearwardly projecting tongue.

10. The carton of claim 9 including a plurality of precuts extending only partially through a bridge portion of said inner top closure flap located between the forwardmost end of said dispensing aperture and the forwardmost end of said inner top closure flap, said front segment of said opening flap being frangibly adhered to said bridge portion.

11. The carton of claim 7 whereby that end panel nearest said opening flap is provided with a top dust flap foldably connected thereto, said foldable connection including a pair of generally curved fold lines, the forwardmost, free edge of said opening flap being convex, the forwardmost, free edge of said inner top closure flap being concave.

* * * * *